US007395977B2

(12) United States Patent
Pinch et al.

(10) Patent No.: US 7,395,977 B2
(45) Date of Patent: Jul. 8, 2008

(54) SPRINKLER APPARATUS

(75) Inventors: Daniel R. Pinch, Clermont, FL (US); Gregory S. Burcham, Clermont, FL (US)

(73) Assignee: Senninger Irrigation Inc., Clemont, FL (US)

( * ) Notice: Subject to any disclaimer, the term of this patent is extended or adjusted under 35 U.S.C. 154(b) by 286 days.

(21) Appl. No.: 10/992,914

(22) Filed: Nov. 22, 2004

(65) Prior Publication Data

US 2006/0108445 A1 May 25, 2006

(51) Int. Cl.
*B05B 3/04* (2006.01)

(52) U.S. Cl. ..... 239/222.21; 239/222.15; 239/222.17; 239/232; 239/233; 239/236; 239/252; 239/264; 239/380

(58) Field of Classification Search ..... 239/222.11, 239/222.17, 222.21, 229, 230, 231, 233, 239/236, 252, 264, 380, 381, 382, 383, 222.15, 239/232, 259
See application file for complete search history.

(56) References Cited

U.S. PATENT DOCUMENTS 4,398,666 A 8/1983 Hunter
4,796,811 A 1/1989 Davisson
RE33,823 E 2/1992 Nelson et al.
5,372,307 A 12/1994 Sesser
5,381,960 A 1/1995 Sullivan et al.
5,439,174 A 8/1995 Sweet
5,671,885 A * 9/1997 Davisson ..... 239/222.17
5,671,886 A 9/1997 Sesser
5,950,927 A 9/1999 Elliott et al.
5,971,297 A * 10/1999 Sesser ..... 239/222.15
6,899,287 B2 * 5/2005 Pinch et al. ..... 239/222.15
7,100,842 B2 * 9/2006 Meyer et al. ..... 239/222.21

* cited by examiner

*Primary Examiner*—Steven J Ganey
(74) *Attorney, Agent, or Firm*—William M. Hobby, III

(57) ABSTRACT

A sprinkler apparatus 10 for providing more even coverage of a sprinkled area with water which is achieved by a different speed of rotation of a water deflector 13 relative to a water diffuser 12 in a wobbling sprinkler head. A diffuser head 11 is rotatably attached to a base 16 and has a water diffuser 12 for diffusing water passing therethrough. A water deflector 13 is rotatably attached to the rotatable diffuser head 11 for directing water emitting from the nozzle 21 through the water diffuser 12. A viscous fluid brake 15 couples the water deflector 13 to the water diffuser 12 to vary the speed of rotation of the water diffuser 12 relative to the water deflector 13 to obtain a more even coverage of the area being sprinkled.

18 Claims, 4 Drawing Sheets

SPRINKLER APPARATUS

BACKGROUND OF THE INVENTION

The present invention relates to an irrigation sprinkler that will apply an evenly distributed pattern of water over a given area and has a rotating water deflector deflecting water through a rotating water diffuser in a wobbling sprinkler diffuser head.

The present invention relates to irrigation sprinklers and especially to sprinklers of the type having a fixed nozzle directing water from a water supply under pressure against a water deflector head which deflects the water into a sprinkling pattern while forcing the deflector head to rotate. The present invention also includes a water diffuser or interrupter which uses diffuser vanes to diffuse the water passing therethrough when the vanes are placed in the water path leaving the water deflector. It has been common in the past to provide wobbling sprinkler heads to wobble the sprinkler head for a better distribution of the water being deflected. Sprinkler heads have also occasionally been provided with various types of brakes to slow the rotation of the water deflector head to prevent rotation at a high speed.

Typical prior U.S. patents for wobbling sprinkler heads can be seen in Applicant's U.S. Pat. No. 5,950,927 to Elliott et al. for a wobbling sprinkler head for use in irrigation systems so that instead of being rotated in a smooth rotation, a water distribution head wobbles in a rotating fashion to provide a more even distribution of water. In Applicant's Sullivan U.S. Pat. No. 5,381,960, a wobbling irrigation sprinkler head includes a magnet to provide for an initial tilt of the sprinkler head. The sprinkler head has a base for attaching to a pipe, such as in a central water supply conduit, which base has a nozzle mounted therein for directing water against a wobbling water deflecting head movably attached to the base. The water deflecting head causes the deflector to rotate and wobble.

In the Hunter U.S. Pat. No. 4,398,666, a stream rotor sprinkler has a rotating head and a crown configured stream deflector positioned about the spray head to deflect water spray from a nozzle in the spray head. The deflector is moved in an eccentrically revolving and rotating motion relative to the sprinkler housing and spray head in response to spray head rotation imparted by a cam on the spray head. In the Sweet U.S. Pat. No. 5,439,174, a nutating sprinkler is provided having a body portion having a nozzle on one end and a cap assembly at an opposite end. A spray plate is used to deflect and distribute water and the distribution distributing grooves are formed to rotate the spray plate which is supported on a universal joint in a manner to cause the spray plate to wobble in one direction of rotation when struck by the stream emitted from the nozzle. This sprinkler is provided with conical gear teeth having stator gear teeth meshing with rotor gear teeth. The Sesser U.S. Pat. No. 5,671,886 is a rotary sprinkler stream interrupter. The stream interrupter is mounted loosely for eccentric rotation about the center axis and has a plurality of stream deflector fingers. This patent also provides a viscous brake or rotor motor of the type disclosed in U.S. Pat. No. RE 33,823 and U.S. Pat. No. 4,796,811 and is used to slow the rotation of the rotor plate. A similar Sesser U.S. Pat. No. 5,372,307 shows a similar rotary sprinkler stream interrupter.

The present rotating sprinkler head is of the wobbling type which includes a sprinkler base attachable to a water supply and having a fixed nozzle for directing water therefrom against a water deflector which is rotated by the water hitting the deflector surface of the deflector.

The present invention incorporates the water deflector into a water diffuser head for diffusing water being deflected by the water deflector and interconnects the water deflector and the water diffuser through a viscous brake which thereby varies the speed of rotation between the water deflector and the water diffuser, resulting in a more even distribution of water over one area while eliminating a shadowing effect behind a diffuser's blades. The wobbling rotation is controlled by a set of meshing gears including a fixed set of gear teeth on the base and a rotating pair of gear teeth attached to the rotating diffuser head. An uneven number of gear teeth forces a deflection of the diffuser head while also forcing a rotation of the entire diffuser/deflector head.

BRIEF DESCRIPTION OF THE DRAWINGS

Other objects, features and advantages of the present invention will be apparent from the written description and the drawings in which.

SUMMARY OF THE INVENTION

Figure 1:
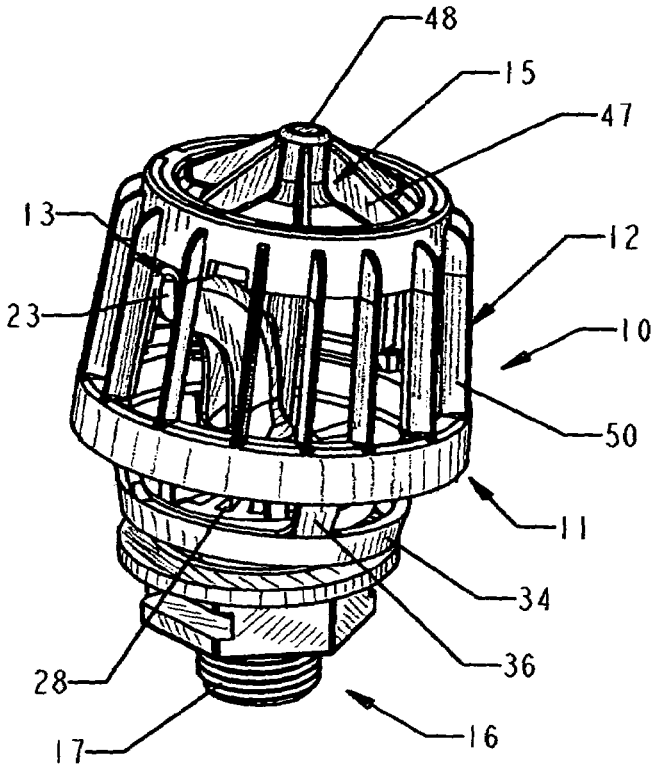
FIG. 1 is a perspective view of a sprinkler head in accordance with the present invention.
Figure 2:
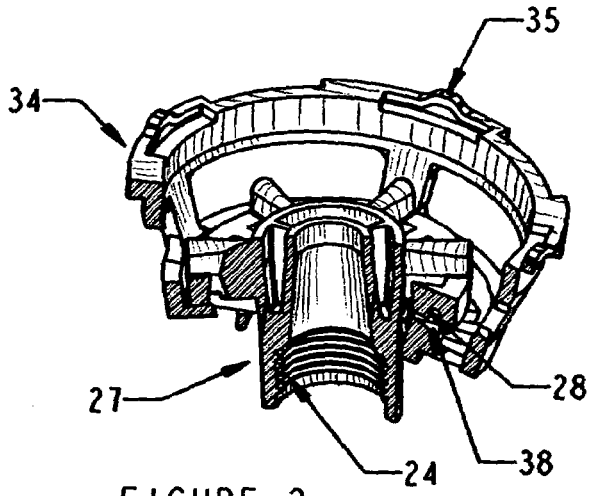
FIG. 2 is a cutaway perspective view of the sprinkler head of FIG. 1.

A sprinkler apparatus 10 for providing more even coverage of a sprinkled area with water is achieved by a different speed of rotation of a water deflector 13 relative to a water diffuser 12. A sprinkler base 16 is connected to a water supply and has a nozzle 21 attached to the base 16 for directing water entering the base therefrom onto the deflector 13. A diffuser head 11 is rotatably attached to the base 16 and has a water diffuser 12 for diffusing water passing therethrough. A water deflector 13 is rotatably attached to the rotatable diffuser head 11 for directing water emitting from the nozzle 21 through the water diffuser 12. The water deflector 13 has a water deflecting surface 23 shaped to rotate the deflector and the diffuser head 11 with the water impinging thereupon from the nozzle 21. A brake 15 couples the water deflector 13 to the water diffuser 12 to vary the speed of rotation of the water diffuser 12 relative to the water deflector 13 to obtain a more even coverage of the area being sprinkled. The diffuser head 11 is loosely connected to the sprinkler base 16 to allow the diffuser head 11 to tilt and rotate on the base 16. The sprinkler base 16 has gear teeth 28 thereon and the diffuser head 11 has gear teeth 38 thereon positioned to engage sprinkler base gear teeth 28 when the sprinkler is activated and water from nozzle 21 impinges upon the water deflector 13. The sprinkler base 16 and diffuser head 11 have a different number of gear teeth to prevent full engagement of the sprinkler base 16 and the diffuser head 11 gear teeth 28 and 38 and thereby causes a wobble in the diffuser head 11 during rotation thereof. The diffuser head 11 gear teeth 38 extend below the base gear teeth 28 so that the gear teeth partially engage only when water is directed against the water deflector surface 23 to lift the diffuser head 11 and gear teeth 38 into engagement with the base 16 gear teeth 28. The brake 15 coupled between the water deflector 13 and the water diffuser 12 is a viscous fluid brake which has a brake disc 44 riding in a brake chamber 43 in the diffuser head 11. Brake 15 is attached to a rotatable shaft 14 extending therefrom to which the water deflector 13 is fixedly attached. The viscous brake 15 uses a viscous fluid between the rotating brake disc 44 and the brake chamber 43 surface. An air bleed 44 in the top of the brake 15 is for bleeding air from the viscous fluid without allowing the fluid to escape during assembly of the brake. The viscous brake chamber 43 is also shaped to avoid the escape of viscous fluid around the shaft 14 extending from the brake disc 44 to the water deflector 13.

DESCRIPTION OF THE PREFERRED EMBODIMENT

Referring to the drawings FIGS. 1 through 5, a sprinkler 10 is illustrated having a diffuser head 11 having a water diffuser 12 thereon and a water deflector 13 attached to a shaft 14. The shaft 14 is connected to a rotatable disc brake 15 located in the top of the diffuser head 11. The sprinkler has a base 16 having external threads 17 for attaching to a water source. Base 16 has an opening or passageway 18 from the bottom 20 through the base and through a water nozzle 21 where it exits the water nozzle 21 through the opening 22 and directs water into a shaped deflector surface 23 on the water deflector 13.

The base 16 has the nozzle 21 supporting portion 27 threadedly attached with threads 24 so as to allow the removal of the nozzle portion 27 from the base. The base nozzle portion 27 has a circular ring of gear teeth 28. An O-ring 26 is positioned below the nozzle 21 so that when the nozzle holder 27 is attached to the base 16, it forms a seal. Thus, a base nozzle holder 27 has the gear teeth 28 thereon and supports the nozzle 21 and is removably attached to the base 16. The diffusion head 11 includes the diffuser 12 and a viscous brake shaft 14 for supporting the water deflector 13.

The diffuser/deflector head 11 has a support bracket 34 which has snap attachments 35 for attaching to the diffuser 12. The support bracket 34 has a plurality of arms 36 supporting a gear ring 37 having a plurality of gear teeth 38 thereon. There are a different number of gear teeth 38 on the support bracket 34 from the number of gear teeth 28 on the nozzle holder 27 so that when they are meshed, they can only partially mesh together which forces a wobble during the rotation of the diffuser 12.

Figure 3:
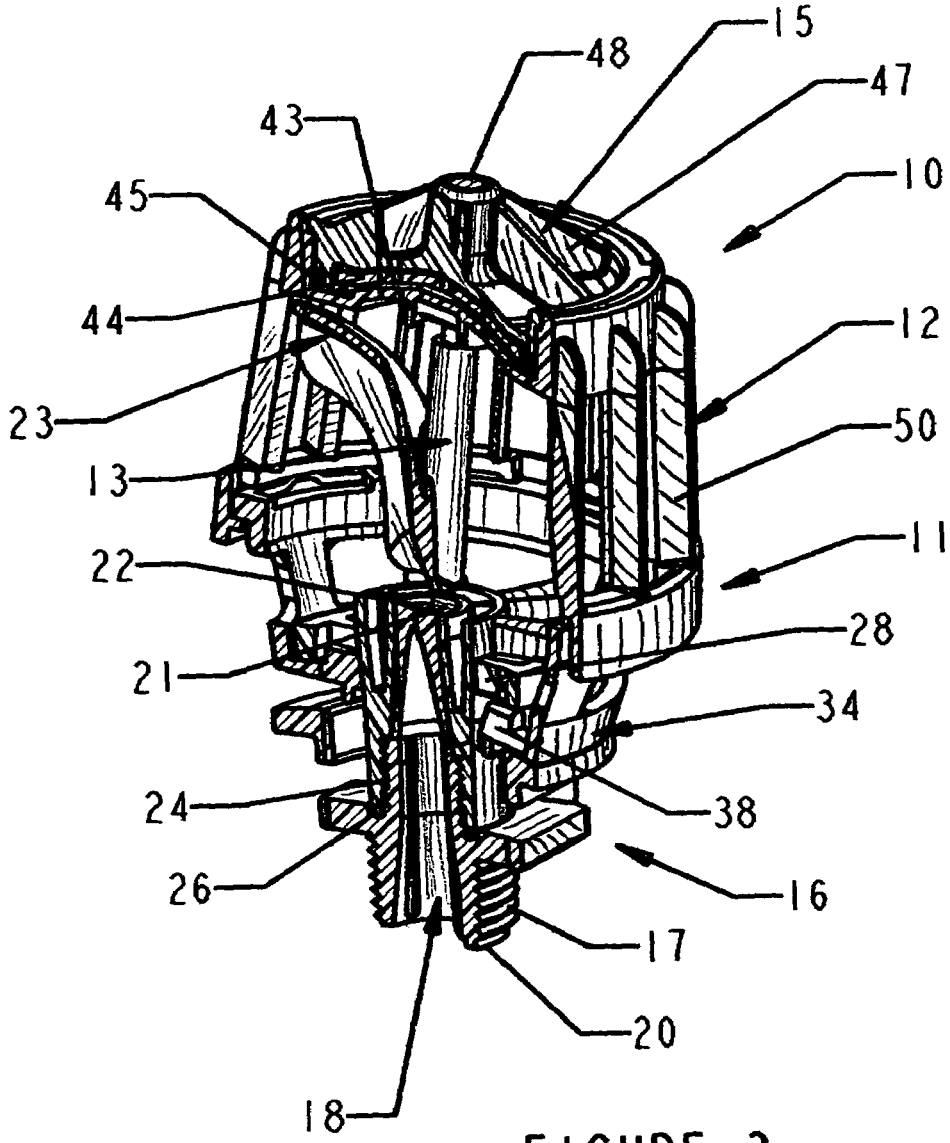
FIG. 3 is a sectional view of the sprinkler head of FIG. 1.
Figure 4:
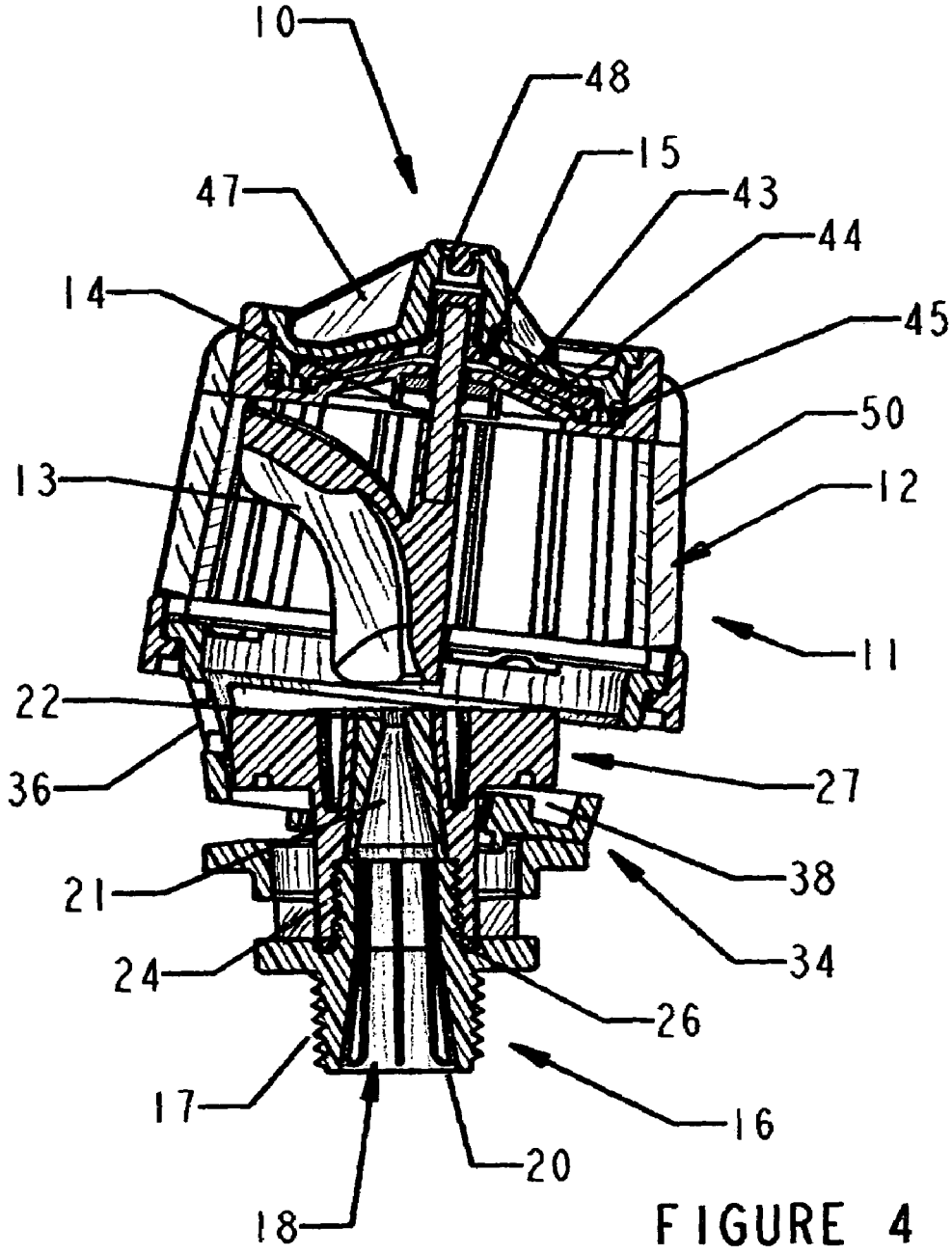
FIG. 4 is an exploded perspective view of the sprinkler head of FIGS. 1-3.
Figure 5:
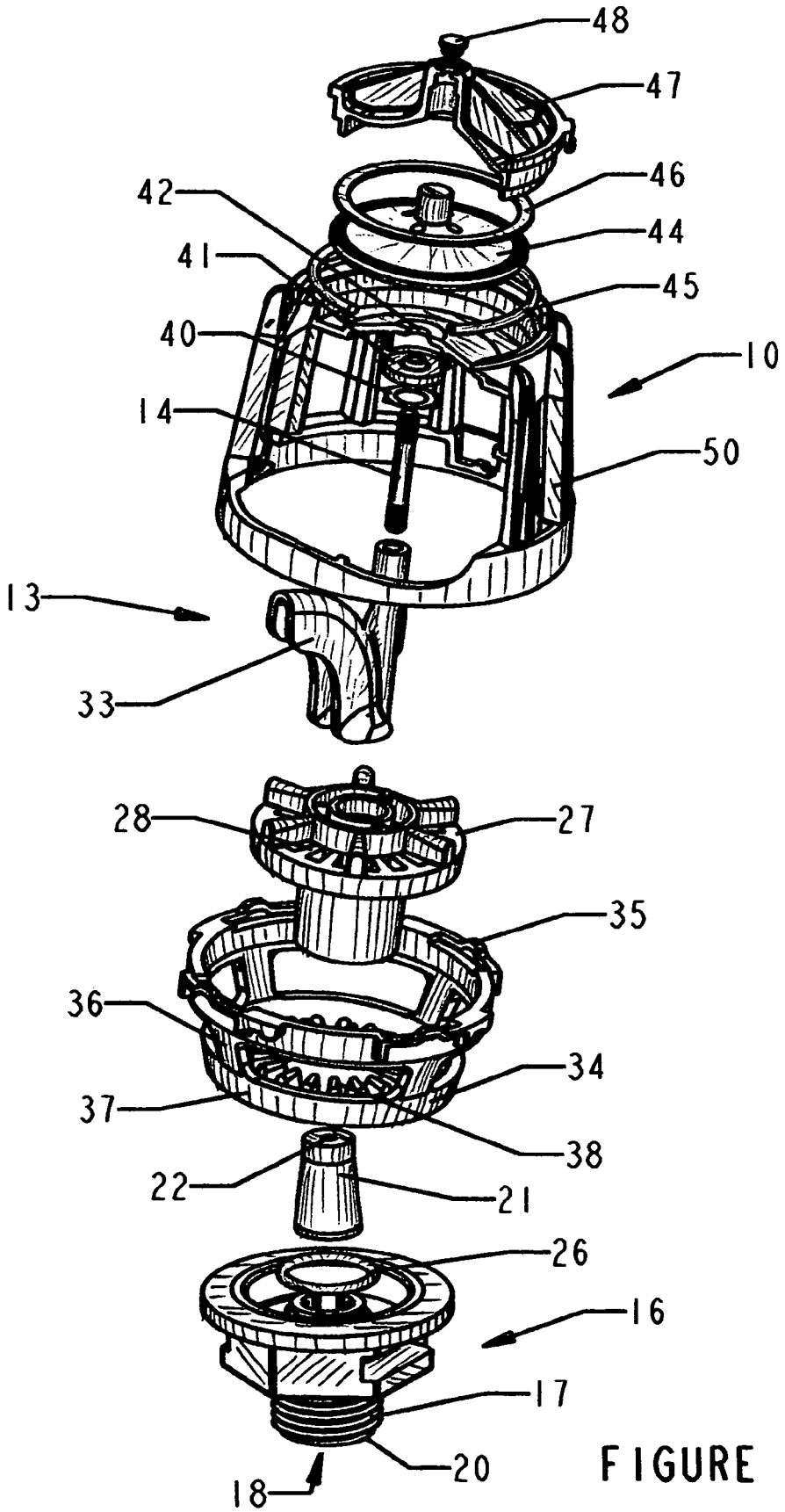
FIG. 5 is a sectional view taken through the base of the sprinkler with the gears partially meshed.

The viscous brake shaft 14 has a spring clip 40 and a shaft seal 41 for sealing the shaft 14 passageway 42 into the brake 15 brake chamber 43 having the brake disc 44 therein attached to the shaft 14. Advantageously, the disc 44 has a bigger diameter than prior art brake disc and extends downward in a generally cone-like shape, as seen in FIG. 3, which places a portion of the brake disc 44 in the brake 45 below the shaft opening 42 into the brake chamber 43 so that in the event of a failure of the seal 41, all of the viscous fluid within the brake chamber 43 will not leak out. The brake chamber 43 has a viscous fluid therein, such as a silicone fluid including dimethyl silicone. The brake disc 44 is placed within the chamber 43 and is held in place with a Teflon thrust washer 44 on the top side. A brake housing top portion 47 seals the brake disc 44 within the brake chamber 43 with O-ring 45. The brake housing top 47 has a bleeder plug 48 in the top thereof which allows air to bleed from the brake chamber during assembly of the brake housing top 47.

Water enters the base 16 and passes through the nozzle 21 and is directed against the deflector 13 into the deflector surface 23 which forces the deflector to rotate and since the deflector 13 is attached to the diffuser 12 through the brake 15, the diffuser 12 is also forced to rotate with the deflector thereby rotating the entire diffuser head 11. Since the deflector 13 is attached to the diffuser 12 through the brake 15, it slows the rotation rate of the deflector 13 relative to the diffuser 12. The difference in the speed of rotation thereby is constantly changing the position of the diffuser water deflecting vanes 50 relative to the motion of the water deflector 13. The water being deflected from the deflector surface 23 passes through the openings between the vanes 50 and intermittently impinges upon them. The deflector vanes 50 diffuse the water as it passes thereby from the deflection of the water from the deflector 13. The deflector 13 is mounted to the viscous brake shaft 14. As the diffuser head 11 rotates, the diffuser head is pushed upwards so that the gears 38 on the support bracket 34 are lifted into engagement with the gears 28 on the nozzle holder 27 but, since an uneven number of gears are meshing, the diffuser head 11 is forced to wobble and advance rotationally. Thus, the sprinkler obtains a superior distribution of the water by the advances of the diffuser deflector head and with the different speeds of rotation of the deflector 13 relative to the diffuser 12.

The gear teeth 28 and 38 are not allowed to fully mesh because of the unequal numbers of gear teeth on the nozzle holder 27 and the support bracket 34. In one example, the nozzle holder 27 can have 18 gear teeth while the support bracket 34 can have 19 teeth which thus causes the support bracket to always be tilted to one side when the gears are meshed. The water enters the base 16 and a stream of water leaves the nozzle 21 and impacts on the deflector 13. The deflector 13 offsets the water stream and angles it from a horizontal of between 10 and 25 degrees. The deflector groove 23 is offset from the center axis and curved radially so that the velocity of the water exerts a torsional force on the deflector as the stream impacts and exits the deflector. The deflector 13 is designed with a generally conical inlet so as to automatically reposition itself into the center of the stream even if the diffuser 13 is tilted to an unfavorable position at startup. The force from the stream of water not only causes the deflector 13 to rotate but also tips the diffuser 11 off axis from the base 16 axis, such as by seven degrees, which engages the gears underneath the stream exiting from the deflector 13. When in a rest position, the sprinkler's diffuser head is mounted in the vertical upright position without water flowing through the unit, the axis of all parts are approximately in-line and the gears are not engaged. The support bracket 34 changes angles very slightly as it rotates due to the gear teeth engaging or disengaging and the torsional forces incurred from the stream exiting the deflector 13. The deflector 13 is coupled to the diffuser 12 through the use of a viscous brake 15. As the stream leaves the deflector, torque is transmitted to the viscous brake 15 through the viscous brake shaft 14. The brake assembly is an integral part of the diffuser head 11 and is designed so as to rotate at approximately one to four RPM. It is desirable for the diffuser 12 to rotate so that there are no voids in the area sprinkled thus avoiding a leg shadow from the diffuser vanes 50. The gearing is used to control the rotation of the diffuser 12 in such as manner that it advances one tooth per revolution of the deflector 13. As the stream of water exits the deflector, it not only imparts torque to the brake shaft 14 but also has a side force that keeps the gear teeth engaged that are underneath the stream exiting the deflector 13. As the deflector 13 slowly rotates, the tooth engagement between the gears follows a thrust since there is one more tooth in the support bracket 34 than in the nozzle holder 27, one revolution of the deflector 13 advances the gear arrangement one tooth. As illustrated, there are 18 teeth on the nozzle holder 27 and 19 teeth on the support bracket 34 so that the support bracket rotates approximately 18.91 degrees per revolution of the deflector. The trajectory angle of the stream varies only slightly as the unit rotates due to the fact that there is only one water stream groove and therefore the deflector is always forcing the support bracket 34 onto the nozzle holder 27 at the same angle.

The invention thus creates an irrigation sprinkler that will apply an evenly distributed pattern of water over a given area to irrigate a field. The gearing is used to facilitate the unit to begin its rotational movement and to assure that the deflector 13 and the diffuser 12 and the diffuser head 11 will not slip uncontrollably in its rotation movement due to torque incurred from the water stream. The gearing on the nozzle holder 27 and a support bracket 34 are designed so that the diffuser 12, which is attached to the support bracket 34, rotates and assures that there are no voids in the sprinkled area. The diffuser 12 and the deflector 13 rotate at different speeds to assure even coverage over the sprinkled area.

The sprinkler, advantageously, has no fixed support bracket as in prior art sprinklers which have stationary legs to support the brake and in which the legs interrupt the stream as it passes, causing voids in the sprinkled area. The brake 15 slows the rotation speed for less wear and greater stream radius. The deflector 13 is coupled to the diffuser 12 through the brake mechanism 15 which allows each to rotate at a different rpm.

It should be clear at this time that a wobbling sprinkler has been provided which advantageously rotates the sprinkler deflector and the sprinkler diffuser together at different speeds of rotation so as to provide a greater coverage of an area being sprinkled. However, the present invention is not to be construed as limited to the form shown which are to be considered illustrative rather than restrictive.

We claim:

1. A sprinkler comprising:

a sprinkler base connectable to a water supply;

a nozzle attached to said base for directing water entering said base therefrom;

a diffuser head rotatably attached to said base and having a water diffuser for diffusing water passing therethrough, said diffuser head being loosely connected to said sprinkler base to thereby allow said diffuser head to tilt and rotate on said base;

a water deflector rotatably attached to said rotatable diffuser head for directing water emitted from said nozzle through said water diffuser, said water deflector having a water deflecting surface shaped to rotate said deflector and diffuser head with the water impinging thereupon from said nozzle; and a brake coupling said water deflector to said water diffuser to thereby vary the speed of rotation of said water diffuser relative to said water deflector;

whereby a more even coverage of a sprinkled area is achieved by the different speed of rotation of said water deflector relative to said water diffuser.

2. The sprinkler in accordance with claim 1 in which said sprinkler base has gear teeth thereon *and said diffuser head has gear teeth thereon positioned to engage said sprinkler base gear teeth when said sprinkler is activated and water from said nozzle impinges upon said water deflector.

3. The sprinkler in accordance with claim 2 in which said sprinkler base and said diffuser head have a different number of gear teeth to thereby prevent full engagement of said sprinkler base and said diffuser head gear teeth to thereby cause a wobble in said diffuser head during rotation thereof.

4. The sprinkler in accordance with claim 3 in which said diffuser head gear teeth extend below said base gear teeth whereby said diffuser head gear teeth and said base gear teeth engage when water is directed from said nozzle against said water deflector surface to lift said diffuser head gear teeth into engagement with said base gear teeth.

5. The sprinkler in accordance with claim 4 in which said deflector surface is shaped to lift and rotate said diffuser head upon water impinging thereupon from said nozzle.

6. The sprinkler in accordance with claim 1 in which said brake is a viscous fluid brake.

7. The sprinkler in accordance with claim 6 in which said water deflector is attached to a rotatable shaft having a brake disc attached thereto riding in a brake chamber in said diffuser head.

8. The sprinkler in accordance with claim 7 in which said brake chamber has a viscous fluid therein between said rotating brake disc and said brake chamber surface.

9. The sprinkler in accordance with claim 8 in which said brake chamber has an air bleed in the top thereof for bleeding air from said viscous fluid during assembly.

10. The sprinkler in accordance with claim 9 in which said viscous fluid is dimethyl silicone.

11. The sprinkler in accordance with claim 8 in which a portion of said brake chamber and brake disc extend below a deflector shaft passageway into said brake chamber to thereby prevent leakage from said brake chamber around said shaft.

12. A wobbling sprinkler comprising:

a sprinkler base connectable to a water supply and having a collar having a predetermined plurality of gear teeth thereon;

a nozzle attached to said base for directing water entering said base therefrom;

a rotatable water deflector having a water deflector surface thereon positioned to deflect water from said nozzle, said water deflector having a base gear ring loosely attached under said base collar to allow said water deflector to be raised and rotated on said sprinkler base when water impinges upon said water deflector from said nozzle and said base gear ring having a predetermined plurality of gear teeth different from said base collar plurality of gear teeth to thereby allow only partial engagement of said water deflector base gear ring gear teeth with said base collar gear teeth thereby causing said water deflector to wobble and advance rotationally; and a water diffuser rotatably attached to said deflector for diffusing water deflected by said water deflector.

13. The wobbling sprinkler in accordance with claim 12 in which said rotatable water deflector has a water deflecting surface shaped to lift and rotate said diffuser head upon water impinging thereupon from said nozzle.

14. The wobbling sprinkler in accordance with claim 13 having a brake coupling said water deflector to said water diffuser to thereby vary the speed of rotation of said water diffuser relative to said water deflector.

15. The sprinkler in accordance with claim 14 in which said water deflector is attached to a rotatable shaft having a brake disc attached thereto riding in a brake chamber in said water diffuser.

16. The sprinkler in accordance with claim 15 in which said brake chamber has a viscous fluid therein between said rotating brake disc and said brake chamber surface.

17. The sprinkler in accordance with claim 16 in which said brake chamber has an air bleed in the top thereof for bleeding air from said viscous fluid chamber.

18. The sprinkler in accordance with claim 17 in which a portion of said brake chamber and brake disc extend below a deflector shaft passageway into said brake chamber to thereby prevent leakage from said brake chamber around said shaft.

* * * * *